United States Patent [19]

McBride et al.

[11] Patent Number: 5,016,308

[45] Date of Patent: May 21, 1991

[54] METHOD AND APPARATUS FOR PATTERNING SUBSTRATES USING GAS STREAMS

[75] Inventors: Daniel T. McBride, Chesnee; William H. Stewart, Jr., Campobello, both of S.C.

[73] Assignee: Milliken Research Corporation, Spartanburg, S.C.

[21] Appl. No.: 473,124

[22] Filed: Jan. 31, 1990

Related U.S. Application Data

[63] Continuation of Ser. No. 399,361, Aug. 28, 1989, abandoned, which is a continuation of Ser. No. 180,406, Apr. 12, 1988, abandoned.

[51] Int. Cl.[5] ..... D06B 1/02; D06B 11/00

[52] U.S. Cl. ..... 8/149; 8/149.1; 8/151; 8/158; 68/5 A; 68/5 D; 68/205 R

[58] Field of Search ..... 8/149, 149.1, 151, 158, 8/483, 484, 505, 932; 68/5 A, 5 D, 200, 202, 203, 205 R

[56] References Cited

U.S. PATENT DOCUMENTS 4,934,008 6/1990 McBride ..... 8/149

FOREIGN PATENT DOCUMENTS 2411027 9/1975 Fed. Rep. of Germany ..... 8/483

*Primary Examiner*—Philip R. Coe

*Attorney, Agent, or Firm*—Kevin M. Kercher; H. William Petry

[57] ABSTRACT

A method and apparatus for patterning a substrate wherein liquid unfixed dye is applied to the substrate in the form of a spray. One or more streams of pressurized gas such as air are then directed onto the substrate for the purpose of displacing some of the unfixed dye where the streams impinge the substrate, thereby causing a visually distinctive area on the substrate where the relative dye concentration is reduced. Resulting products are also disclosed.

7 Claims, 11 Drawing Sheets

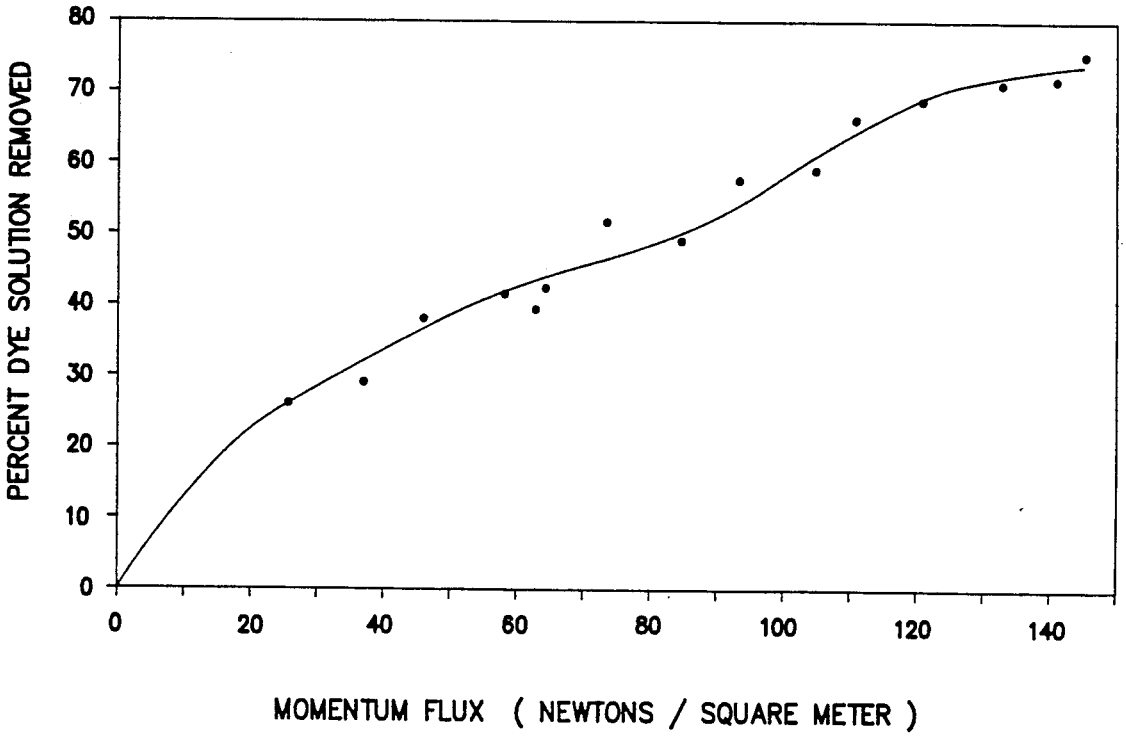
*FIG. –17–*

METHOD AND APPARATUS FOR PATTERNING SUBSTRATES USING GAS STREAMS

This application is a continuation of application Ser. No. 399,361 filed on Aug. 28, 1989, and now abandoned, which was in-turn a continuation of application Ser. No. 180,406 filed on Apr. 12, 1988, and now abandoned.

This invention relates to an apparatus and process for generating patterns on textile substrates carrying unfixed liquid dyes. More particularly, this invention is directed to an apparatus and process for pattern dyeing textile substrates wherein at least one stream or jet of pressurized gas is directed at the surface of a textile substrate to which has been applied an undried and unfixed liquid dye in the form of a spray, and to the resulting products.

In one preferred embodiment, a textile substrate carrying an unfixed and undried liquid dye, which has been applied in a pattern configuration using one or more fine sprays of dye propelled onto the substrate by a first set of gas jets, is subjected to one or more jets of air from a second set of jets at relatively close range. The mechanical action of the impinging jets or streams from the second set of jets on the unfixed dye is sufficient to displace or remove, from the area of impact, dye which has not been adsorbed onto the surface of the constituent fibers, thereby removing or redistributing unfixed dye and causing the area of impact to have a significantly lower dye concentration in the area of jet impingement. This area, upon fixing of the dye, is therefore dyed a visually lighter or less saturated shade of the dye than the surrounding non-impacted area.

As used herein, the term liquid dye shall be used to mean dyes, inks, or the like comprised of soluble matter in a solvent, as well as dyes or marking materials comprised of insoluble matter in a liquid medium. The term substrate is intended to encompass a wide range of textile constructions, such as woven or knitted fabrics, and may include non-woven constructions. Both flat and pile-like fabrics have been successfully patterned using the teachings herein, and are intended to be included in the term textile substrate as well. Fabrics comprised of various synthetic yarn types may be used including, but not limited to, polyester, nylon, and acrylic yarns. It is believed any yarn type or fabric construction which allows some unfixed liquid dye to be redistributed or removed by the action of an impinging gas stream may be patterned using the teachings herein. As used herein, the term "momentum flux" is used to describe the relative concentration of momentum of the air stream (i.e., the product of air mass and air velocity) striking the substrate. By using momentum flux as a parameter, various other process variables such as gas pressure, gas stream velocity at impact, and gas stream cross-sectional area may be implicitly accommodated.

Many techniques are known to apply dye to a textile substrate for the purpose of patterning the surface of the substrate. Among the most common is the direct application of dye of the desired colors to a previously dyed or undyed substrate. This technique is known as direct printing. Perhaps the most widely used direct printing technique is screen printing, in which dye or ink is forced through a specially prepared screen onto the substrate. The screen has areas in which the mesh has been blocked. These areas, which remain impervious to the dye or ink, correspond to pattern areas on the substrate in which no ink or dye is desired. Another direct printing method is known as metered jet printing, in which dye is selectively applied to an untreated substrate surface by one or more streams of dye which are positioned to strike the substrate surface as the substrate moves through the dye streams. The streams may be either continuously flowing onto the substrate surface, or may be intermittently initiated or interrupted in a variety of ways in accordance with pattern data. This method, which may afford some flexibility in pattern configuration, often requires a complex arrangement of valves and dye discharge devices which are costly and may require careful or continuing adjustment.

A characteristic of either technique is the limitation of shade flexibility generally afforded by such techniques due to the practical need to use a separate dye mix for each desired shade, and the limited number of dye mixes usually available for each substrate pass.

Another printing technique is resist printing, wherein a resist chemical is first applied to a dyed or undyed substrate in a specified area. The resist chemical can contain a dye or pigment. After fixing the resist, the substrate surface may be applied with a dye which, due to the blocking effect of the resist, does not affect the areas under the resist. Because of the multiple steps required, this process is more costly than applying a single batch of dye directly to the substrate. Furthermore, the control of color intensity or shading must be accomplished through the use of carefully formulated resist chemicals. Generally, it is difficult to achieve even moderately fine gradations of shading with this technique.

Discharge printing is yet another printing technique wherein a previously dyed or undyed substrate is dyed overall with a background shade, after which a chemical agent is applied to the substrate to discharge or chemically reduce the color of the background shade and eliminate, at least partially, the background shade from that area of the substrate. The background dye mix can contain dyes resistant to reduction by the discharge agent. In areas containing such dyes, the background color will remain. In addition, the discharge mix can itself contain dyes which are intended to replace or re-dye areas from which the original background dye has been chemically reduced. This technique requires highly specialized and expensive dyes, and is difficult to control if fine or uniform shade gradations are to be reproduced dependably.

These methods all provide acceptable results under some circumstances, but all share shortcomings which have been overcome by embodiments of the invention disclosed herein. In particular, all the above-mentioned techniques require carefully controlled formulations of dye and/or dye modification agents to be effective, and further require that, for each desired color shade, a separate formulation of dye or dye modification agent be used, or that the residence time of the dye modification agent be carefully controlled. Each such formulation must be made up in advance, and must be loaded into the appropriate patterning equipment prior to the start of the patterning operation. Once under way, desired variations in the pattern or shading are limited to those possible with the existing mix of dyes and/or dye modification agents. In addition, all these conventional techniques are ill-suited to generate softly-defined patterns characterized by regular or random-appearing dyed areas having diffuse, unobtrusively blended perimeters and wide shade variations within the dyed areas.

The invention disclosed herein provides a method for dyeing a textile substrate with a variety of shade variations of a given background (which may be comprised of one or more colors arranged in a diffuse pattern), without the uncertainty associated with resist or discharge printing techniques, and without the inflexibility or complexity associated with certain direct printing techniques. Specifically, the invention provides a method in which a variety of patterns and shade variations may be reproducibly generated on a moving textile substrate by first selectively applying and subsequenty removing or redistributing, in a controlled, selective manner, the previously applied unfixed and undried liquid dye from the substrate to produce various color shades and patterns. In a preferred embodiment, the unfixed liquid dye is applied in a pattern configuration, using one or more streams or jets of gas (e.g., air) to generate a fine spray of liquid dye droplets and, at the same time, direct such spray onto selected areas of the substrate surface. The unfixed liquid dye is then further patterned by selective redistribution or removal of the dye by the impingement of an independent set of gas jets (e.g., air) in accordance with the teachings herein to produce a novel effect. This embodiment uses jets of gas to apply dye in a pattern and then uses different jets of gas to rearrange or remove, in a similar or a different pattern, some of the dye so applied.

In accordance with the invention, unfixed and undried liquid dye on a substrate surface may be applied by the use of an array of gas streams or jets which generate a spray of dye droplets in the direction of the substrate. The applied dye may then be removed or redistributed by one or more independent streams or jets of pressurized gas directed at close range onto selected areas of the substrate surface. It has been discovered that patterns which are particularly visually attractive may be produced by a two stage process in which the background color of the substrate is applied in a pattern configuration using a first array of gas jets (e.g., air jets) to spray the substrate with dye droplets (Stage 1), followed by rearrangement or removal of the dye, using a second array of gas jets (e.g., air jets) (Stage 2). The preferred gas for both Stage 1 and Stage 2 patterning is air at ambient temperature, although other gases may be used if desired. The dye application technique of Stage 1 is the subject of commonly assigned pending U.S. patent application Ser. No. 07/062,141, filed June 15, 1987.

One particular advantage of using this background generating technique is that the general diffuse character of the patterns forming the background is matched by the diffuse character of the patterning achieved by the dye rearrangement/removal technique. A second particular advantage of using this background generating technique is the opportunity it presents to control both the color application and color removal processes —which are both dependent upon the control of gas jets directed at the substrate surface—with a single computer-driven process control system, making it convenient to generate patterns in register using the Stage 1 and Stage 2 processes running in tandem.

In the Stage 1 dye application technique of this invention, one or more arrays of closely spaced streams of liquid dye or ink are normally directed into a collection trough; in a preferred embodiment, a diverting surface or lip is used to intercept the streams and channel the liquid dye into the collection trough. Each stream in a given array has associated with it a source of pressurized fluid, for example, air, which, on command, forms and directs an atomizing stream or jet of air on a path which brings the atomizing air stream into contact with the streams of liquid dye or ink, whereby the streams of ink or dye are transformed into a mist of variously sized droplets of ink or dye which are propelled, by the combined momentum of the liquid and air streams, in the direction of the substrate to be marked. By interrupting the streams of atomizing air in oscillatory fashion, thereby causing the air to contact the liquid in bursts of extremely short duration, and by superimposing upon such oscillatory pulsations relatively longer-term patterning instructions which control the number of such pulsations to be executed by each individual atomizing air stream in each sequence of oscillations, uniform reproduction of various solid color or multi-hued patterns is possible. By employing such controlled pulsations, as well as by varying the distance over which the resulting spray must travel to reach the substrate and/or adjusting the physical position of the diverting surface with respect to the liquid stream and air stream sources, and with respect to the substrate, it has been found that droplet size distribution and the degree of droplet dispersion can be carefully controlled, yielding intricate patterns possessing great subtlety, delicacy, and variety which may be produced with a high degree of repeatability. By providing for the non-simultaneous actuation of adjacent atomizing air streams along a given array, a wide variety of side-to-side (i.e., across the width of the substrate web) patterns may be produced. By providing for multiple arrays, multiple color combinations may be employed, or, if preferred, combinations of dye and bleach or dye resist or other dye modifying compositions may be used.

In operation, the continuous stream of liquid dye tends to produce some droplets which are substantially larger than the fine mist ordinarily associated with an atomization process such as is employed herein. For purposes herein, the term "microscopic fragmentation" shall be used to describe the process whereby the liquid dye is broken up into a relatively fine mist, i.e., where droplet average diameter is generally substantially smaller than about 0.1 or 0.2 millimeter. The term "macroscopic fragmentation" shall be used to describe the process whereby the liquid dye is broken up into droplets having an average diameter on the order of about 0.1 or 0.2 millimeter, or larger.

It is believed that as the continuous stream of dye is interrupted by the advancing stream of air, the dye stream is atomized in the region of the stream directly in line with the advancing wave front of pressurized air, which results in microscopic fragmentation of the dye. That portion of the dye stream immediately above or below this in-line region remains coherent, but tends to become entrained in the periphery of the passing air stream and tends to separate into relatively large droplets and irregularly shaped spatters of dye (i.e., it undergoes macroscopic fragmentation) which are propelled toward the substrate.

In the following discussion, air at ambient temperature is assumed to be the gas of choice, with the understanding that other gases may be used as desired. By controlling the various parameters associated with the delivery of dye and air onto the substrate, a variety of shade variations may be produced, each shade being represented by a given reduced quantity per surface area of the liquid dye on the fabric surface. Where only a relatively small amount of unfixed dye has been removed over a given area by the impinging air stream, the resulting shade will be relatively close to the background color generated by the fully concentrated dye. Removing a relatively larger amount of dye from the area will result in a more "diluted" color or tone being generated, as viewed against the fully concentrated background level of unfixed dye. The resulting color may be a blend of the unfixed background dye color and the color of the substrate prior to the application of the unfixed dye. It is therefore possible to obtain a wide variety of multi-color effects based upon the blending of the underlying substrate color and various concentrations of the unfixed dye.

Where multiple colors are desired, the prompt application of a second liquid dye, as by spraying or other non-smearing means, to a substrate surface still wet from an initial application of dye results in the second color coating on the surface being relatively easy to remove using the teachings herein. It is believed that a substantial amount of the first or base layer of applied dye is adsorbed onto the fiber surfaces and becomes relatively securely attached thereto, even though unfixed. Subsequent applications of dye must look to areas of the fiber surface not yet occupied by a component of the first dye to find an adsorption site, or, finding no adsorption site, must occupy the interstitial voids between adjacent fibers or yarns. This results in the second dye having a relatively low and/or weak adsorption level, and permits substantial quantities of the second dye to be more readily removed or redistributed in accordance with the teachings described herein.

A special advantage of this invention is that the chosen shade variations may be modified while the substrate is being patterned—no prior preparation in the nature of formulating special dyes or other chemicals, or loading the patterning device with such dyes or chemicals, is required. Additionally, the process may be implemented using the computer controlled apparatus disclosed herein. As aided by such computer controlled apparatus, the invention may provide the following practical advantages:

(1) shade and pattern changes may be made at any time during the patterning process;
(2) variations in both shade and pattern may be made in carefully controlled and repeatable increments;
(3) computer generated patterns may be easily stored for reuse at any time;
(4) complex patterns involving pattern changes across the full width or length of the substrate may be easily accomplished, and may be reproduced on demand;
(5) where a sprayed-on background pattern as taught herein is used, the air jets used to redistribute or remove the unfixed dye may be directed in registration with the background pattern, since both air jet patterning processes may be computer controlled and may be performed at fixed positions along the substrate path.

Further features and advantages of this invention will be made evident by the following detailed description, when read in conjunction with the accompanying drawings, in which:

FIG. 1 schematically depicts an elevation view of an apparatus embodying the invention which may be used to generate a patterned background on a non-porous substrate which is further patterned by dye redistribution or removal;

FIG. 2 schematically depicts the apparatus of FIG. 1 adapted for use with a porous substrate;

Figure 1:
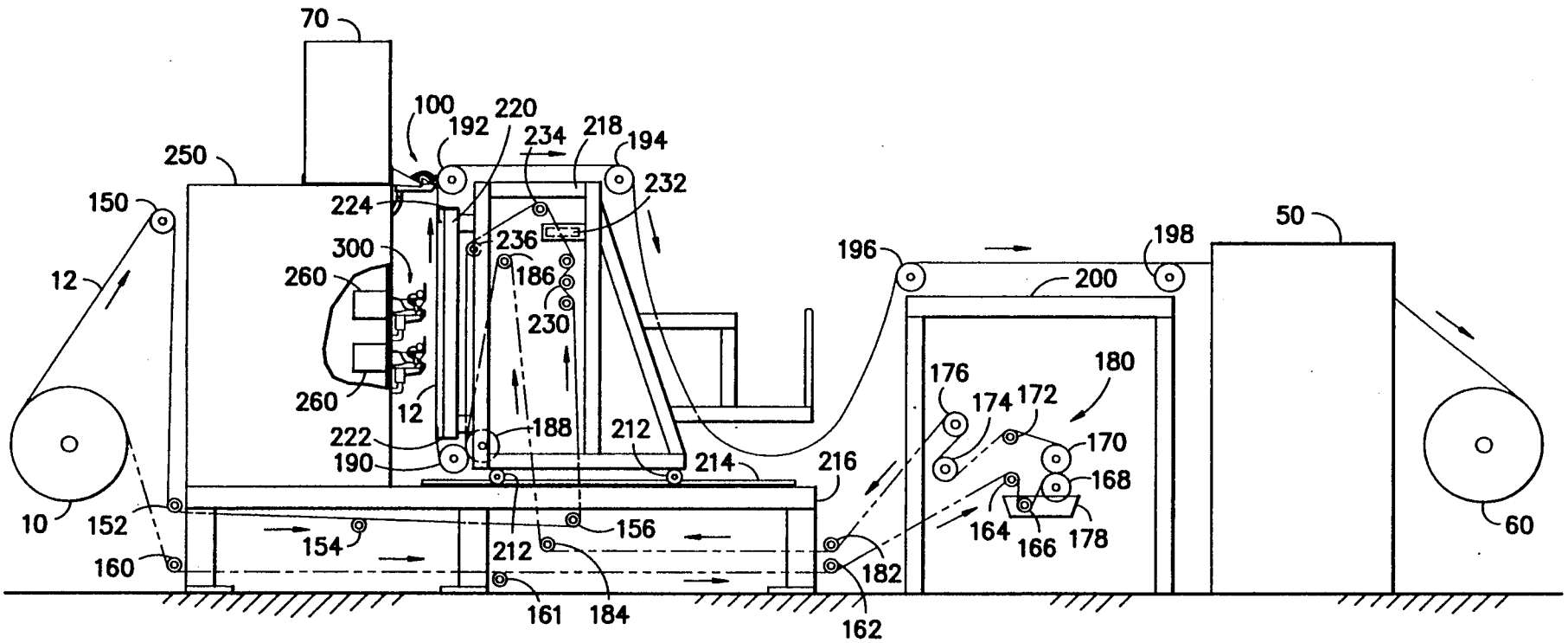
Figure 2:
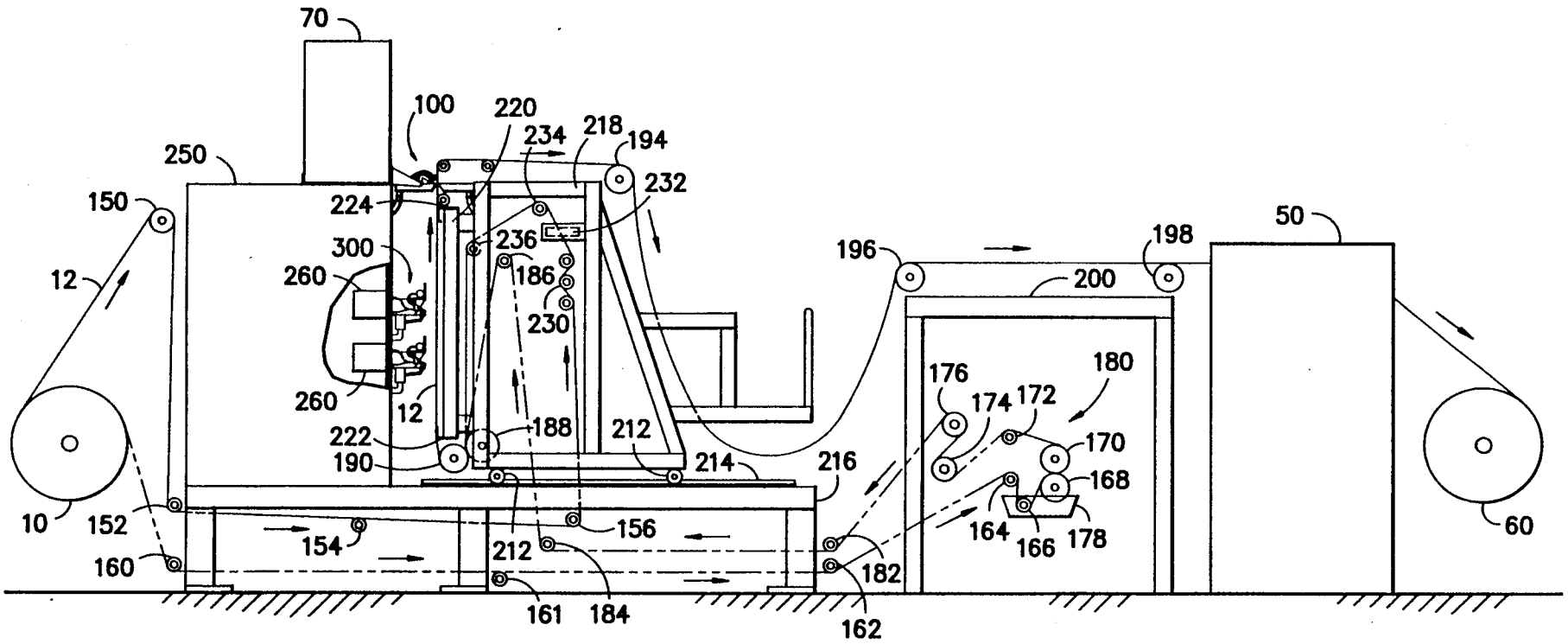
Figure 11:
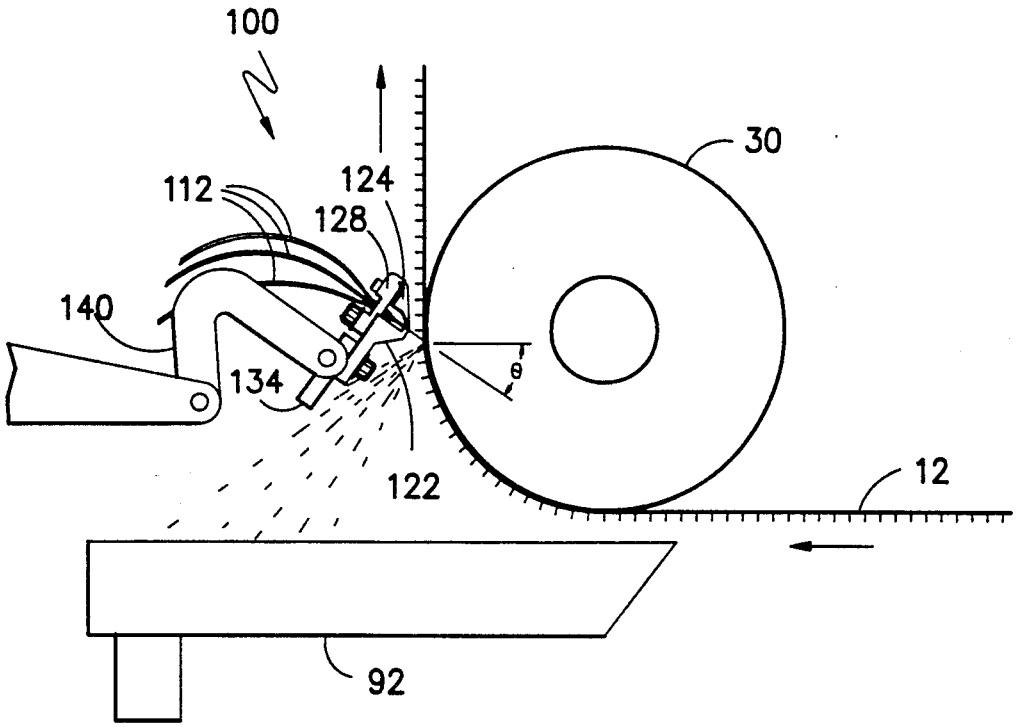
Figure 12:
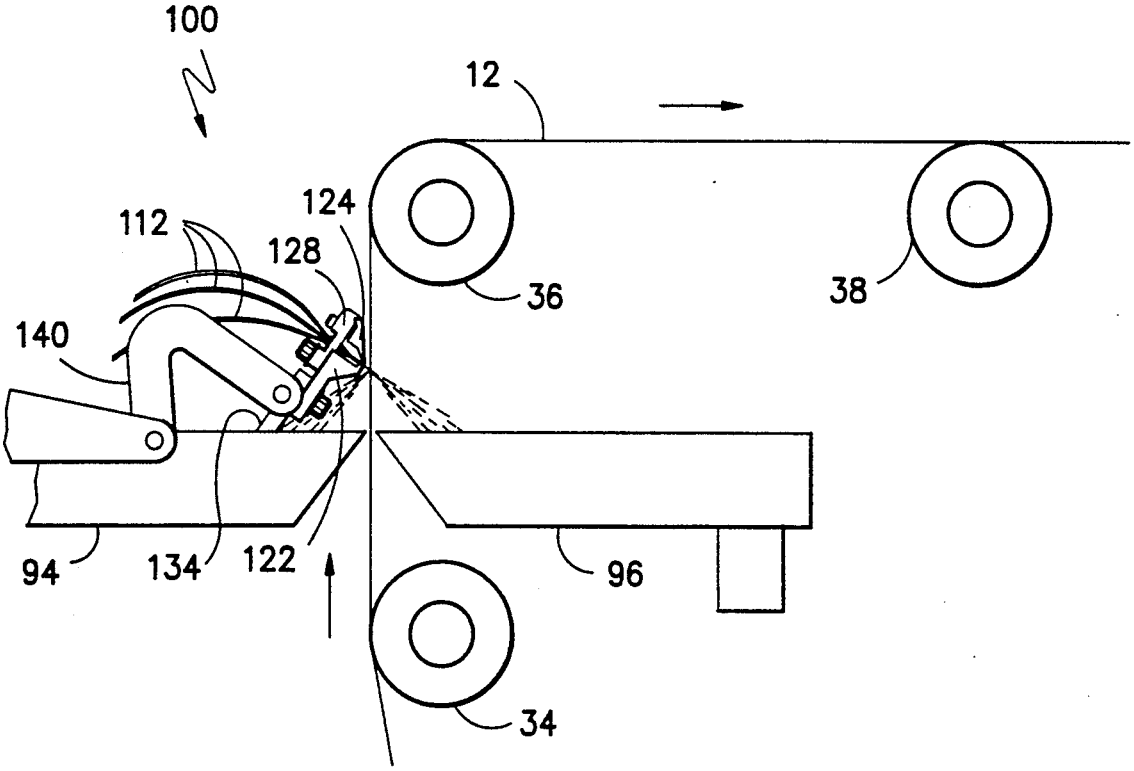
Figure 13:
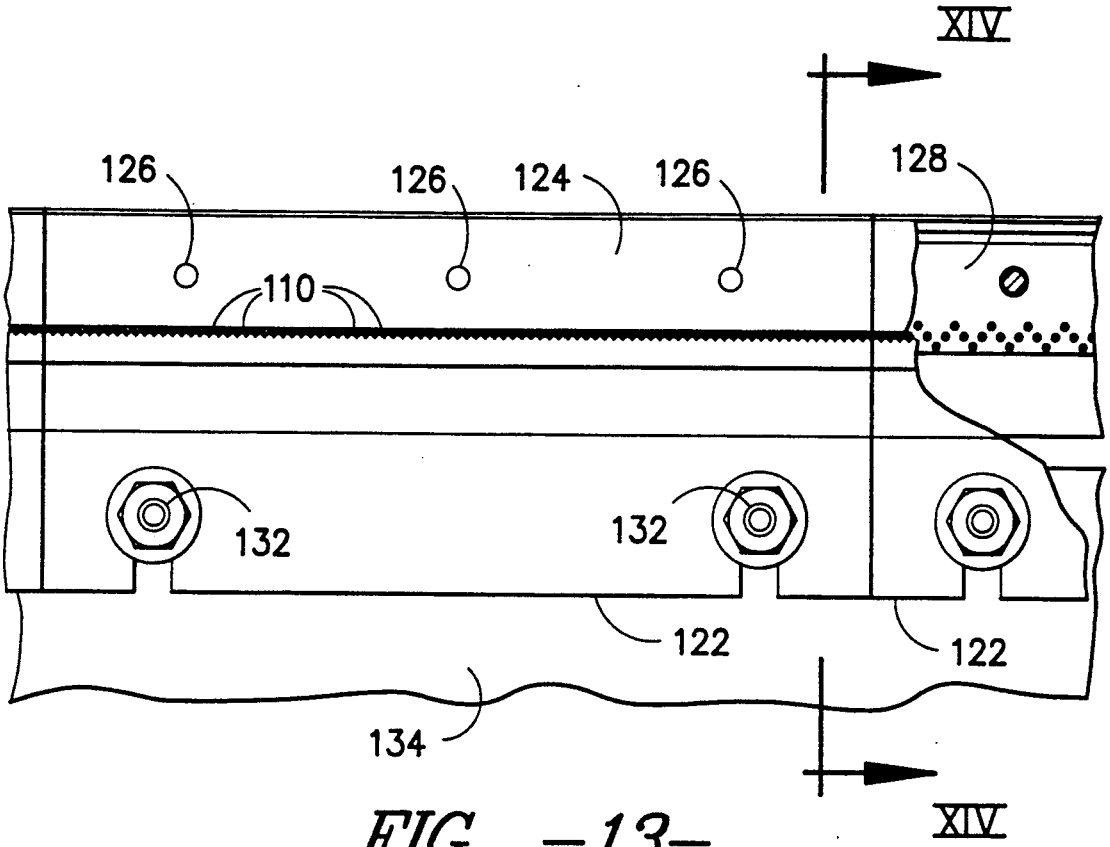
Figure 14:
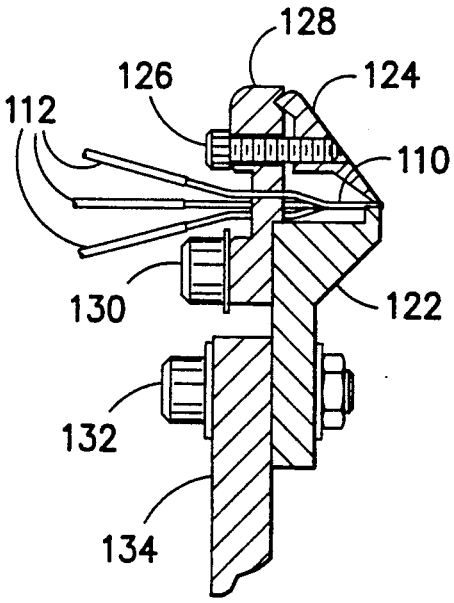
Figure 15:
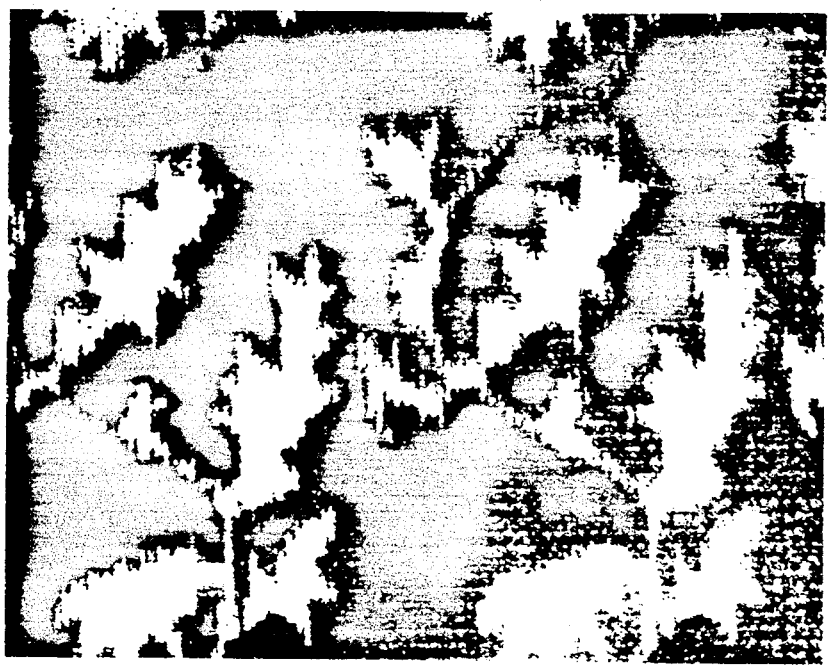
Figure 16:
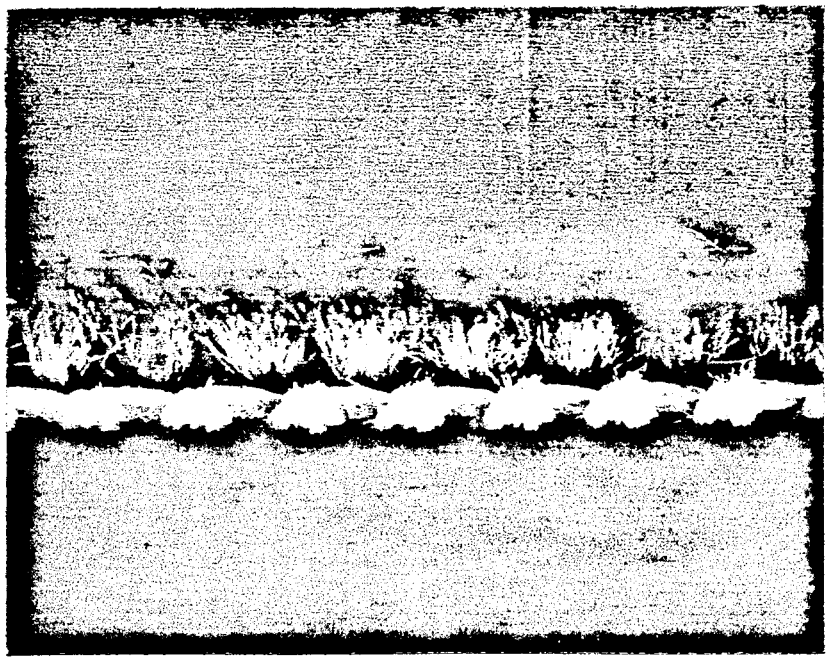

FIG. 11 schematically depicts the Stage 2 patterning portion of the apparatus of FIG. 1, wherein the jet is directed against a backing member;

FIG. 12 schematically depicts the Stage 2 patterning portion of the apparatus of FIG. 2, wherein the jet penetrates the substrate and no directly opposing backing member is used;

FIG. 13 is a frontal view (i.e., as seen generally from the substrate surface) of the jet array of FIGS. 11 and 12;

FIG. 14 is a sectional view, taken along line XIV—XIV, of the array of FIG. 13;

FIG. 15 is a photomicrograph (1.15 X) showing the face of the patterned knitted fabric of Example 1;

FIG. 16 is a photomicrograph (10 X) showing, in cross-section, the fabric of Example 1; and FIG. 17 is a plot showing the effect of increasing momentum flux on percentage of liquid dye removed.

Depicted in FIGS. 1 and 2, respectively, are alternative apparatus configurations for treating textile substrates in a first set of gas jets (at 300) are used to apply a spray of liquid dye onto the substrate (Stage 1), and a second set of gas jets (at 100) are used to pattern the substrate by removing or rearranging the sprayed-on dye (Stage 2). In the apparatus configuration of FIG. 1, the gas jets 100 are intended to be reflected from the textile structure and the underlying backing member almost exclusively (as shown in FIG. 11), while in FIG. 2 the gas jets 100 are intended primarily to pass through the substrate, but with some of the gas being reflected by the yarns comprising the fabric substrate (as shown in FIG. 12). As configured, the apparatus of FIGS. 1 and 2 provide for either continuous pad dyeing, via the conventional pad dyeing arrangement depicted at 180 and comprised of driven roll 164, dye bath 178, and opposed driven nip rolls 168,170, or the gas jet-generated spray dyeing, via the arrangement depicted at 300, which arrangement is discussed in more detail below. The user may elect, by appropriately configuring the path of the substrate web within the apparatus, to generate a solid background via the pad dyeing arrangement or generate a solid or patterned background using the spray dyeing arrangement.

Figure 3:
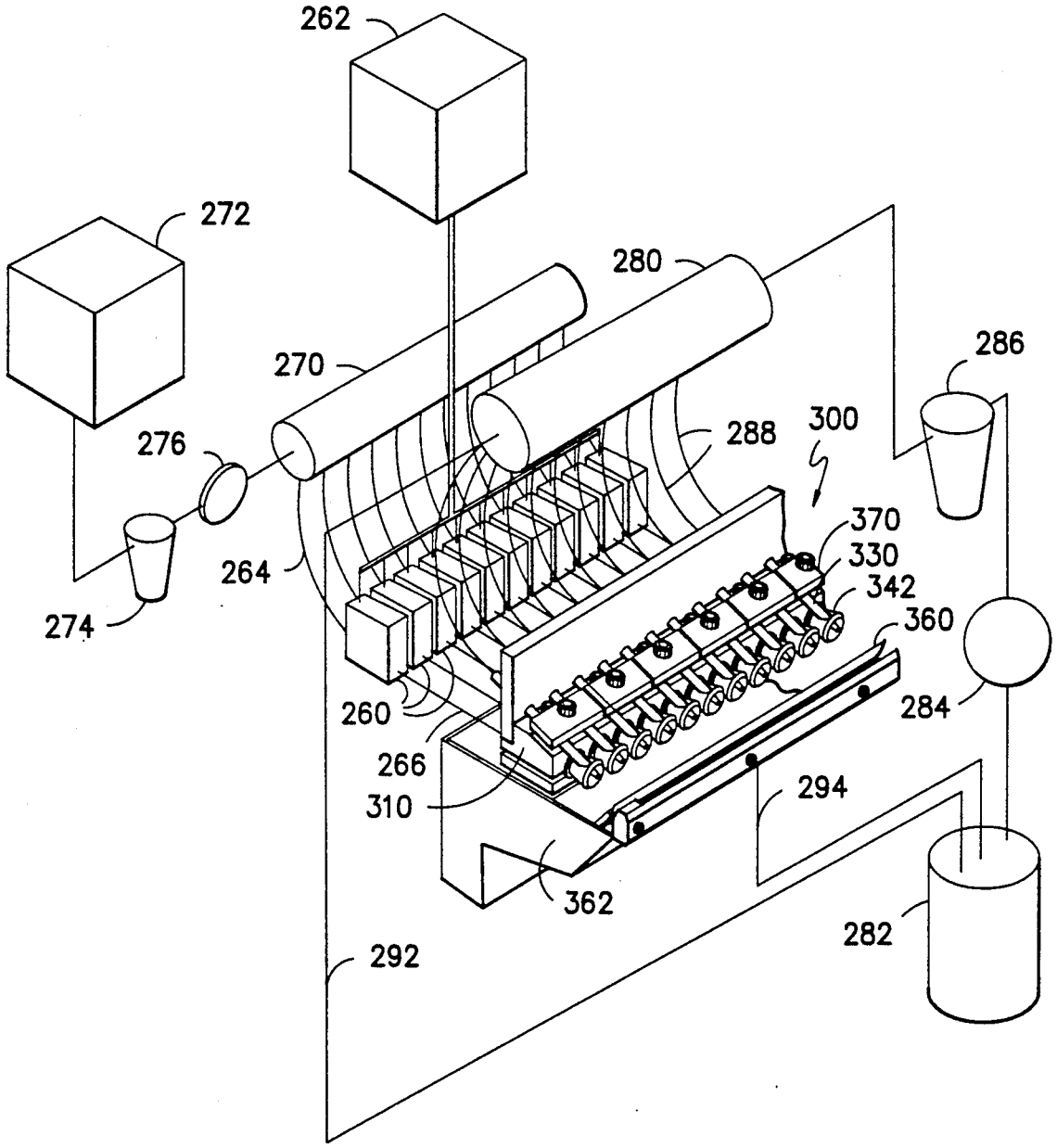
FIG. 3 shows, in schematic form, a dye spray generator array of the type depicted at 300 in FIGS. 1 and 2, and the associated dye and gas handling apparatus.

Referring more specifically to the Figures, FIGS. 1 and 2 show, diagrammatically, an overall side elevation view of apparatus suitable for patterning a web of moving substrate material using the Stage 1 and Stage 2 patterning processes in tandem. The embodiment shown in FIG. 1 employs a backing member positioned directly opposite the dye redistribution/removal array 100, as generally shown in FIGS. 1 and 3. This configuration is generally preferred if a relatively gas-impervious substrate is used, but may be used with other substrates as well. Where the gas jet from array 100 is intended to pass through the substrate, the substrate support arrangement generally shown in FIGS. 2 and 4 may be substituted in the apparatus of FIG. 1, using rolls 191,193 positioned adjacent to the region of stream impact, as shown in FIG. 2.

Substrate 12 is supplied from any suitable source, e.g., roll 10, and is drawn over roll 150 and under roll 152 and valve house 250 to roll 156 which rotates in bearings fixed to platform 216. Substrate 12 is then directed into the interior of rolling frame 218, which is supported on wheels 212 and which may be moved along track 214 to adjust the distance between frame 218 and valve house 250, and, correspondingly, between arrays 300 and the surface of substrate 12. This permits easy and immediate observation of the effects of changing the spacing between valve house 250 (and the associated arrays 300 of spray generators) and the face of substrate 12. Substrate 12 is directed around roll group 230 and rolls 234,236 and through driven nip rolls 188,190, and is then presented, in a preferred embodiment, in a substantially vertical orientation to the multiple arrays 300 of spray generators mounted on the face of valve house 250. As shown in FIGS. 1 and 2, in a preferred embodiment, the substrate 12 may be separated from an appropriate backing member 220, which may be comprised of plastic or other dye-impervious material, by spacers 222,224 positioned along the top and bottom edges of backing member 220 above and below the level of the spray generator arrays 300, thereby assuring no contact between the back of substrate 12 and the backing member 220. This prevents unwanted smearing on the back of the fabric and prevents excessive saturation or accumulation of dye visible on the face of the fabric. In a particularly preferred embodiment, lower spacer 222 may be in the form of a trough-like collector which can serve to collect the sprayed liquid dye which may pass through substrate 12 and collect on backing member 220. Substrate 12 is then directed over backing roll 192 and over tension-generating roll 194, which may have a surface covered with rubber or the like and which may be overdriven to assure that substrate 12 is relatively taut in the region adjacent to arrays 300. As shown, substrate 12 may then be guided to an appropriate dye fixation means 50 or other post treatment processor. If desired, photoelectric cells may be used to determine the elevation of the catenary formed by substrate 12 between rolls 194 and 196, and thereby adjust the speed of the drive motor(s) associated with nip rolls 188,190 and roll 194.

Figure 4:
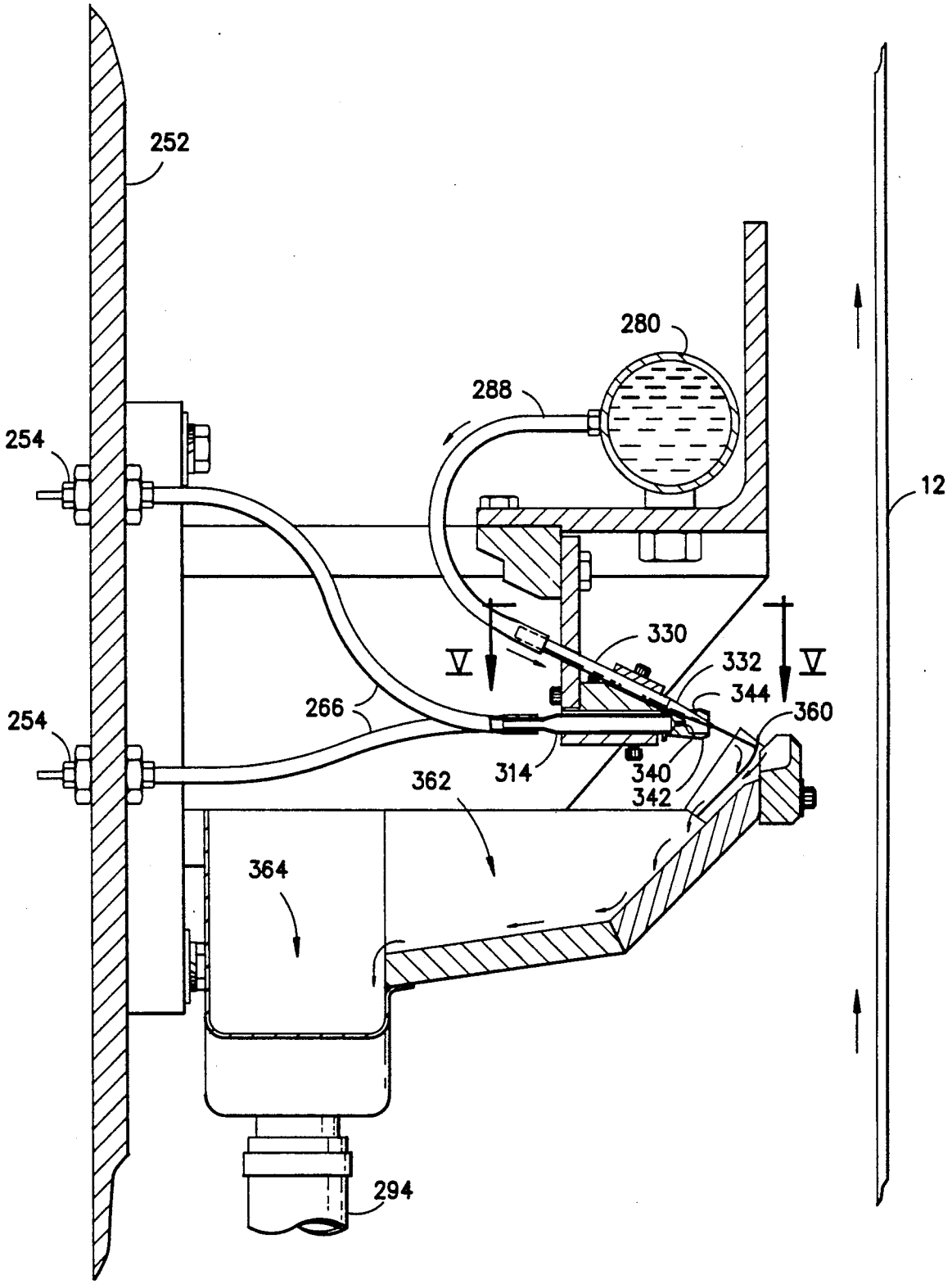
FIG. 4 depicts, in a cross section taken along a vertical plane perpendicular to the longitudinal axis of array 300 and bisecting a dye pipe 330, a side view of the spray generator of FIG. 3.
Figure 5:
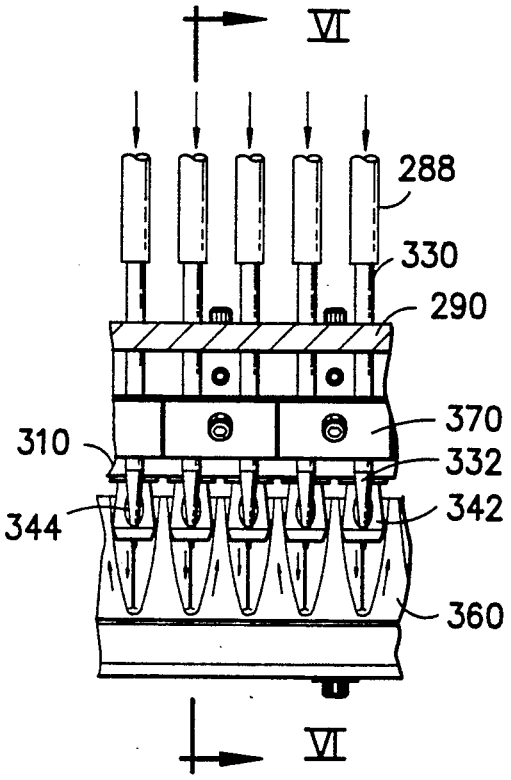
FIG. 5 depicts a plan view of a portion of the array 300 shown in FIG. 3, as seen along line V—V of FIG. 4.

FIGS. 3 through 10 collectively illustrate a preferred embodiment of the spray generator of the type depicted at 300 in FIGS. 1 and 2. FIG. 4 depicts a partial cross-section view along a vertical plane perpendicular to the longitudinal axis of array 300. The elongate array 300 is comprised of a plurality of individual spray generators, each comprised of a dye pipe 330 and nozzle 332 through which a liquid dye, ink, or other marking material may be pumped, and a dispersing aperture 340 and associated surround 342, through which a relatively high pressure dispersing fluid, for example, air or other gas, may be propelled. For purpose of discussion herein, air at room temperature shall be assumed to be the dispersion fluid. The individual spray generators are mounted in alignment, with an adjacent spacing appropriate to the degree of definition desired. It is believed adjacent lateral spacings of between about 0.2 inch and 1.0 inch, measured from the centerlines of adjacent dispersing apertures 340 along array 300, may be used with good results. Spacings outside this range may be used if, for example, minimal overlap between adjacent spray patterns on the substrate is desired.

As depicted in FIG. 3, further associated with each generator is an electronically controlled valve 260 which is interposed in the pressurized air lines 264 and 266 which serve to supply the apertures 340 with pressurized air from manifold 270, which in turn is suitably connected, via regulator 276 and filter 274, to a source 272 of pressurized air. Valves 260 are, in a preferred embodiment, of the electrically actuated pneumatic type such as those distributed by the Lee Company of Westbrook, Conn. Associated with each dye pipe 330 is dye supply line 288 which extends from dye manifold 280, which is fed, via pressurizing pump 284 and filter 286 and associated conduits, from dye reservoir 282. Dye conduits 292 and 294 supply reservoir 282 with excess dye from manifold 280 and captured dye expelled by nozzles 332 (FIG. 4) into containment trough 362, thus forming, in a preferred embodiment, a recirculating dye system.

Figure 9:
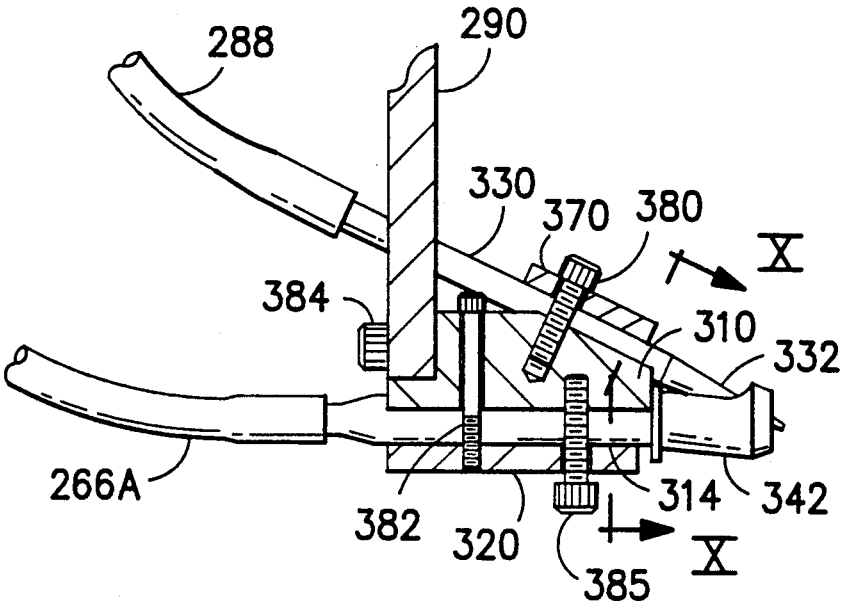
FIG. 9 is a section view, taken along line IX—IX of FIG. 8.
Figure 10:
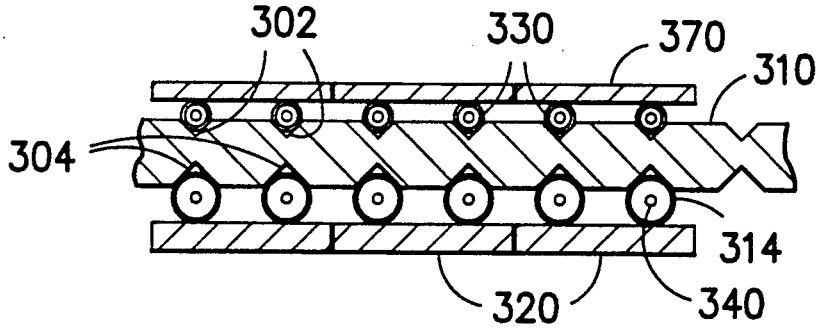
FIG. 10 is a section view taken along line X—X of FIG. 9, depicting the "V"-shaped notches useful in aligning the intersecting gas and dye streams.

As shown in FIG. 10, elongated array frame 310 is constructed with a series of parallel "V"-shaped notches or grooves 302, 304, spaced along its length, in precisely opposed pairs along the top and bottom of frame 310 at intervals corresponding to the desired lateral spacing between adjacent dye pipes 330 and air conduits 314. Air conduits 314 may then be placed within "V"-shaped grooves 304 directly opposite corresponding dye pipes 330, and attached to respective air lines 266 (FIG. 4). By aligning grooves 302, intended to accommodate dye pipes 330, and corresponding grooves 304, intended to accommodate air conduits 314, the intersecting alignment of the corresponding dye and air streams necessary for maximum dye stream fragmentation may be more easily controlled. As shown in FIG. 9, dye pipe positioning plate 370 and air conduit positioning plate 320, respectively secured to frame 310 via laterally spaced bolts 380 and 385, maintain dye pipes 330 and air conduits 314 within their respective "V"-shaped grooves. Due to the self-centering nature of the "V"-shaped grooves 302, 304 (as compared with other possible groove cross-section shapes), no additional stream alignment technique is needed, provided grooves 302 and 304 have been placed directly opposite one another. The array 300, comprising frame 310 and positioning plates 370,320, is suitably attached, via rigid member 290 and mounting bolts 384, to the front face 252 of valve house 200 (FIG. 4).

While the angle between dye pipes 330 and air conduits 314 is depicted as approximately thirty degrees, this merely represents one preferred embodiment. Angles less than and greater than that shown may be advantageously employed under some conditions, so long as the resulting pressurized dye stream is not sent on a trajectory from nozzle 332 which, in the absence of an interacting burst or stream of air, results in continuous contact with the substrate. Air conduit 314 is fitted with a tapered coupling so that air at pressures of 60 p.s.i.g. or more may be transferred to replaceable port aperture 340 from supply line 266 (of which two are depicted in FIG. 4, to indicate a suggested arrangement for accommodating closely adjacent lines 266), which in turn is connected to valves 260 via fittings 254 in front wall 252 of valve house 250. In one embodiment, air valves 260 are situated in close proximity to fittings 254, and may be arranged on a pneumatic circuit board analogous to an electronic circuit board. Such pneumatic circuit board or "valve card" may be equipped with suitable mating fittings so that a valve card carrying a plurality of individual air valves for individually controlling a corresponding plurality of individual spray generators may be merely plugged into corresponding fittings 254 mounted on the inside of front wall 252. In such embodiment, a suitable number of valves 260 may be individually mounted on one such a valve card, with multiple valve cards mounted in adjacent fashion to provide control along the length of the entire array 300.

Associated with aperture 340 is shroud or surround 342, through which nozzle 332 may extend via surround port 344. Surround 342 tends to maintain the high velocity of the dispersing medium jet formed by aperture 340 and to focus the jet in the direction of the substrate. Operation without surround 342 or a similar confining enclosure results in a process which generates an undesirable cloud or mist of dye which is difficult to control in terms of placement, degree of mixing of adjacent sprays, etc.

Figure 6:
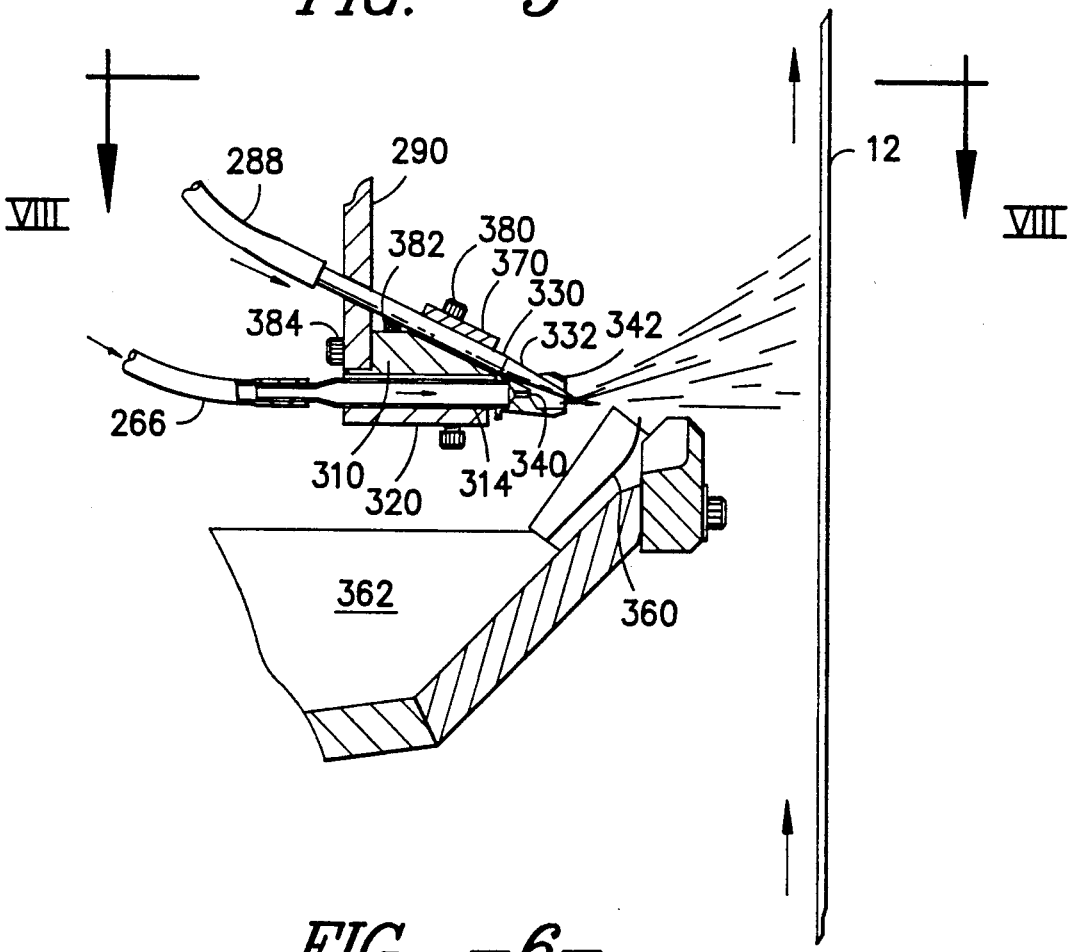
FIG. 6 depicts a section view of a portion of a spray generator illustrating one position of dye nozzle 332 of FIG. 4, as seen along line VI—VI of FIG. 5.
Figure 7:
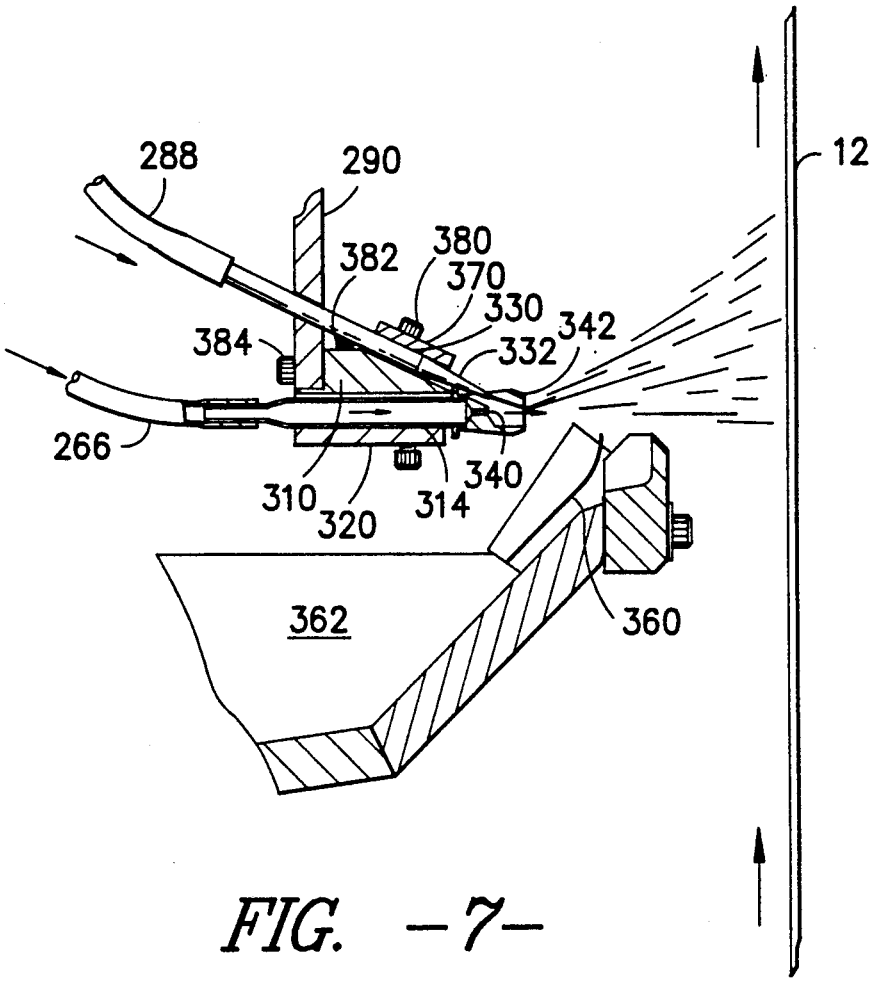
FIG. 7 is a view similar to FIG. 6, showing nozzle 332 in a different position.

Nozzle 332, supplied with slightly pressurized dye via dye supply line 288 and dye supply manifold 280, is associated with pipe 330 which fits within "V"-shaped groove 302. The relative position of nozzle 330 within surround 342 may be changed, as is shown in FIGS. 6 and 7, by moving pipe 330 within groove 302 and locking pipe 330 in the desired position by means of set screw 380 and the clamping action of positioning plate 370. This adjustment has been found to alter the character of the spray by changing the radial distance from the axis of the air jet, and therefore the character (e.g., velocity, pressure, etc.) of the region within the air jet at which the dye is ejected from the protected confines of nozzle 332. Although it is contemplated that nozzle 332 may be located substantially above the axis of aperture 340, it is preferred that nozzle 332 be positioned within surround 342. In a preferred embodiment, the tip of nozzle 332 is positioned at most a short radial distance from the axis of aperture 340 so that, whenever the air stream associated with aperture 340 is actuated, the liquid emanating from nozzle 332 is immediately acted upon by the jet and does not have the opportunity to form a defined, coherent stream except during interruptions in the flow of air from aperture 340.

Perpendicular to the longitudinal axis of dye nozzle 332 and, in the embodiment shown in the Figures, generally situated opposite aperture 340 and parallel to array 300, is a diverting lip or surface 360. Surface 360 is mounted so that dye exiting from nozzle 332 will, in the absence of a disturbing air stream from aperture 340, form a stream which travels in a trajectory which terminates on diverting surface 360 and flows into an associated containment trough 362, as shown in FIG. 4. From trough 362, the dye may be pumped, via dye basin 364 and conduit 294, either back to dye reservoir 282 for re-use or to a suitable waste receptacle. In the preferred embodiment shown, surface 360 may be mounted inside trough 362 to extend upwardly therefrom, and is preferably mounted via a suitable adjusting means so that the degree to which surface 360 extends into or beyond the path of the dye stream, as well as the relative spacing and alignment of the surface 360 with respect to nozzles 332 and surrounds 342 in array 300, may be adjusted. It is contemplated that surface 360 may be relatively rigid or, alternatively, may be a relatively thin, flexible blade which is given rigidity by clamping each end of the blade and applying suitable tension along the length of the blade.

Where the dye stream is squarely impacted by the air stream, microscopic fragmentation takes place, and a relatively fine mist is generated and propelled in the direction of the substrate. A portion of such mist usually strikes diverting surface 360 and coalesces there as liquid dye. As the air stream reaches the region of the diverting surface, a portion of the air stream tends to impinge on the inside of the surface and tends to push any dye which may be there, either as a result of coalescing mist or of having been the target of the uninterrupted dye stream, away from the area of impingement. Some dye is pushed downwardly into the collection trough 362, but some is pushed upwardly, toward the edge of diverting surface 360, and is ultimately pushed over the edge and is carried by the air stream toward the substrate, in the form of larger droplets and irregularly shaped spatters (i.e., the product of macroscopic fragmentation).

When actuated, valves 260 associated with air supply lines 266 prevent air from passing through port aperture 340. As a result, ink is permitted to stream from nozzle 332 to diverting surface 360 without interruption, as shown in FIG. 4, where it is dissipated and collected in containment trough 362 and drip basin 364 and, ultimately, pumped back to dye supply manifold 282 in pressurized form or discarded.

FIGS. 6 and 7 depict the dye applicator in operation where pulses of air, generated by the rapid actuation and deactuation of valves 260, are being supplied to aperture 340. Pressurized air entering conduit 314 and passing through aperture 340 forms a jet which interacts with dye which is continuously supplied from the tip of nozzle 332. The resulting spray of dye droplets is directed onto the surface of substrate 12. In the embodiment shown on FIG. 6, the tip of nozzle 332 is positioned within the region occupied by the jet, so that the dye is acted upon by the jet immediately upon its exit from nozzle 332. This position tends to suppress the formation of the relatively larger spatters, flecks, and blotches associated with macroscopic fragmentation, and tends to encourage the fine mist formation associated with microscopic fragmentation.

As a result of the interaction of the stream of relatively low pressure dye (typically about 0.2 to about 4 p.s.i.g.) with the stream or jet of relatively high pressure air (typically about 5 to about 60 p.s.i.g.) within or in front of surround 342, the stream of dye is dramatically disrupted, and is usually atomized to some degree. In a preferred embodiment, the ratio of dispersing material pressure (e.g., air) to marking material pressure (e.g., dye) will generally fall within a range of about 5 to about 60, but may fall outside this range under certain conditions. For example, if high viscosity marking materials are used, higher than usual dispersing material pressures may be desirable, causing the above ratio to exceed 60.

A variety of droplet sizes and mist is produced, which are generally propelled in the direction of the surface of moving substrate web 12. Web 12 may be positioned typically from about two to about twelve inches from the tips of nozzles 332. By varying factors such as the respective pressures of the dye and air streams, the viscosity of the dye, and the degree to which nozzle 332 protrudes through surround port 344 and intrudes into the air stream flowing from aperture 340, a wide variety of visually attractive commercial products may be generated in a reproducible manner. Other factors which may be varied to change the visual effect produced include the degree to which the diverting surface 360 is made to extend into the area in which the dye spray is generated, the distance between nozzle 332 and diverting surface 360, and the distance between nozzle 332 and substrate 12.

Figure 8:
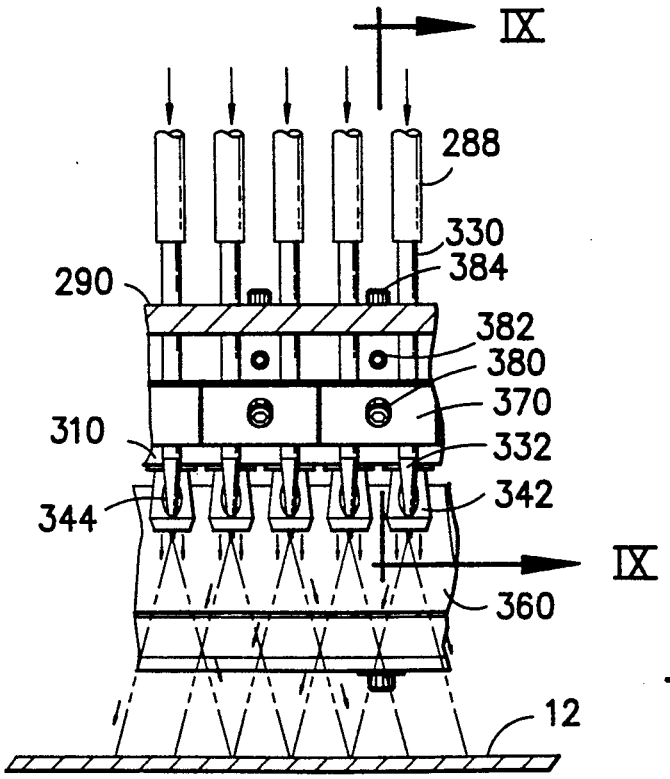
FIG. 8 depicts a portion of the array 300 as seen along lines VIII—VIII of FIG. 6.

The adjacent spacing of the individual nozzles 332 and apertures 340 comprising the plurality of spray generators spaced along the longitudinal axis of array 300 is generally fixed for a given apparatus in order to maintain proper alignment. This spacing is preferably such that, for a given nozzle-to-substrate distance, the spray patterns from immediately adjacent spray generators have substantially overlapping trajectories, allowing for the overlapping and mixing of the spray patterns throughout a significant percentage of the spray path between nozzles 132 and the surface of substrate 10, as depicted in FIG. 8. In a preferred embodiment, the included angle of the spray pattern may be on the order of about 25 to about 50 degrees, the adjacent spacing may be about 0.3 to about 0.6 inch, and the nozzle-to-substrate distance may be from about four to about eight inches. Under such conditions, the overlap and mixing of sprays generated not only from immediately adjacent nozzles 332, but from nozzles 332 spaced two or more nozzle spacings away, has been observed. It is believed such substantial mixing and overlapping of the individual spray patterns while the dye sprays are moving toward the substrate contributes greatly to the blending and diffusion which characterizes the diffuse character of patterns generated by this process.

In a preferred embodiment, the valves 260 controlling the flow of air to aperture 340 are actuated by means of computer control, which permits each of the individual dye streams to be selectively interrupted in response to externally supplied pattern data, thereby providing the capability of reproducing complex side-to-side patterns extending across the width of substrate 12. This computer control may be associated with the computer control used in the Stage 2 dye removal/rearrangement patterning operation which follows this patterning operation. Computer control may also be used to accommodate variations in dye pick-up or dye deposition requirements among different types of substrates, as well as variations in the speed of the substrate as it is drawn through the apparatus. This may be achieved in a manner similar to that disclosed in U.S. Pat. Nos. 3,894,413; 3,969,779; or 4,033,154, or by other appropriate means.

Following application of liquid dye to the substrate 12, the web is directed over one or more rolls positioned opposite impinging jet array 100. In the embodiments shown in FIGS. 1, 2, and 11 through 14, jet array 100 is comprised of a series of parallel, closely spaced tubes 110 (FIG. 13) of relatively small diameter directed at the surface of substrate 12. Each tube is connected to a respective flexible conduit 112 through which pressurized gas is supplied. The outlets of tubes 110 are arranged at a uniform distance from the surface of substrate 12 within array alignment plate 122, shown in cross-section in FIG. 14, which holds individual tubes 110 in rigid alignment as discussed hereinbelow.

As shown in more detail in FIGS. 13 and 14, tubes 110 are arranged in a linear array with minimal spacing between adjacent tubes. One side of each tube 110 is positioned within an individual "V" shaped notch or groove along the lip of an alignment plate 122 which is fastened securely to array bar 134. Opposite plate 122 is positioned pressure plate 124, which contacts the side of each tube 110 protruding from the confines of each "V" shaped notch or groove in alignment plate 122. The action of pressure plate 124 and adjusting bolt 126 urging tubes 110 snugly into their respective notches in alignment plate 122 allows for rigid, repeatable alignment of the outlets of tubes 110 above the surface of substrate 12.

As depicted in FIG. 14, each tube 110 is bent to facilitate side-by-side tube arrangement having minimal adjacent tube spacing measured along the axis of alignment plate 122. Tubes 110 each pass through a drilled passage in support plate 128, which, as shown, is attached to alignment plate 122 via attachment bolts 130. The drilled passages of FIGS. 13 and 14 are depicted in a three hole, quasi-sinusoidal configuration; other configurations may be used. For ease of fabrication, assembly, and maintenance, alignment plate 122, pressure plate 124, and support plate 128 may each be configured in relatively short, abutting sections which are attached to array bar 134 extending across the width of substrate 12. As depicted, array bar 134 is adjustably attached to articulated linkage 140, whereby the array may be adjustably positioned with respect to substrate 12 for patterning, changing substrates, cleaning of the array, etc.

Tubes 110 are each attached to individual conduits 112 through which is supplied pressurized gas of the desired kind, e.g., air at ambient temperature. In a preferred embodiment, each conduit 112 is associated with an individual valve, not shown, which is electrically or pneumatically controlled by externally supplied patterning information, thereby allowing the pressurized gas to flow through any individual conduit 112 and associated tube 110 and onto the substrate 12 only in response to pattern information. The individual valves as well as the source of pattern information (which may be a read-only memory associated with an appropriate computer) may be located in housing 70, as shown in FIGS. 1 and 2. To facilitate positioning array 100 close to the substrate for patterning but away from the substrate for maintenance, changing substrates, etc., housing 70, to which array 100 is attached in the Figures, may be mounted on sliding carriage 72.

Looking now in detail at the apparatus of FIGS. 1 and 11, substrate 12, which may have a pile face, as depicted, or which may be a flat fabric, is directed through an approximate 90° wrap angle around single support roll 30. In a preferred embodiment, roll 30 is smooth and solid, but a foraminous or contoured roll surface may be employed if special patterning effects are desired. Wrap angles other than 90° may be used as desired. However, it is preferred that the substrate to be patterned in this configuration be in contact with the support roll 30 at the point where the jets contact the substrate. This minimizes any tendency of the substrate to oscillate or flap in response to the jet impingement. It also assures maximum reflection of gas and liquid dye from the fabric surface and underlying support surface where the principal mechanism of dye removal is intended to be dye droplets ejected from the face of the substrate. This is the configuration of choice where the substrate construction used is relatively impervious to the gas jets of the kind contemplated herein, as, for example, where back-coated substrates are used, but such configuration may be employed, using a solid backing roll, for any type fabric to produce a characteristic effect.

Depending upon the fabric construction, the gas jet may penetrate the substrate only to a depth of a fraction of a yarn diameter, or may penetrate the substrate until encountering an impenetrable barrier such as a back coating or the surface of the backing roll. The jet is then redirected outwardly from the barrier and substrate. In all cases, the impact of the jet on the substrate causes redistribution of the liquid dye held by the substrate in the area of impact. Specifically, the liquid dye is "squeezed" from the substrate within the area of impact and accumulates as a drop or globule on the substrate surface, and is ultimately ejected by the momentum of the outwardly redirected jet. Catch basin 92 may be used to collect and, if desired, recycle liquid dye ejected from the substrate.

The alternative apparatus configuration of FIGS. 2 and 12 is generally more suited to substrates which the gas jets will penetrate readily, and for which a principal dye removal mechanism will be via dye droplets blown entirely through the substrate and leaving the substrate from the back of the fabric. As shown in detail in FIG. 12, the substrate is positioned opposite jet array 100 via a pair of spaced rolls 34,36 which leave the fabric unsupported, except for web tension, in the region of jet impact. This unimpeded path through the substrate, when used with an appropriately chosen substrate construction (i.e., one which is readily penetrated by gas jets of the kind contemplated herein) results in a substantial part of the impinging gas passing through the substrate, pushing or carrying droplets of liquid dye with it in the direction of catch basin 96. Because some dye droplets also emerge from the face of substrate 12 due to reflective interactions with the individual yarns comprising substrate 12, a second catch basin 94 placed below the face of the substrate may be employed. If recycling of the dye is desired, catch basins 94,96 may be associated with dye recycling filters, pumps, etc., not shown.

In the embodiment of FIGS. 1 and 11, as well as the embodiment of FIGS. 2 and 12, the angle at which the gas jets are directed at the substrate (the impingement angle) may be adjusted over a wide range. It has been found that, although significant effects may be observed at any angle which allows the gas streams to impinge the fabric, a preferred attack angle lies within the range of 0°–60°, as measured from the perpendicular of the substrate at the region of impact and as indicated by the angle $\theta$ in FIG. 11. The measurement of the impingement angle in the embodiment of FIG. 12 is similar. Impingement angles within the range of about 25° to about 45°, and particularly within the range of about 30° to about 40°, are especially preferred. While the preferred relative direction of substrate travel is as indicated in the Figures (i.e., jets directed against the direction of substrate travel), operation in the reverse direction may be desirable under some circumstances. When patterning a pile fabric, it has also been found generally advantageous, although not necessary, to orient the pile so that the action of the jets tends to lay the pile down further in the same direction, rather than raising the pile.

The generation of uniform background shades upon which patterns may be imparted by jet array 100 may be achieved using the spray dyeing arrangement depicted at 300 in FIGS. 1 and 2, or by other appropriate means known in the art.

Dyes or other marking materials having a wide variety of flow characteristics may be used with the Stage 1 dyeing technique described herein; generally speaking, higher viscosity liquids tend to increase the degree of macroscopic fragmentation which occurs, while lower viscosity liquids tend to increase the degree of observed microscopic fragmentation. Various thickeners, thixotropic or pseudoplastic agents, surface tension modifiers, and the like have been used with interesting results. For example, use of agents such as guar gum which cause the liquid dye to become "stringy" causes the resulting pattern of dye on the substrate to contain a random line segment pattern element which somewhat resembles portions of a spider web, and which contains blobs or nodes of dye positioned at various intervals along the length of the line segments.

FIGS. 1 and 2 both depict a treatment zone 50 following the gas jet patterning station described hereinabove. It is contemplated that treatment zone 50 may be used for drying and fixing the pattern dyed substrate, as appropriate, immediately following the patterning step and prior to storage of the pattern dyed fabric on take-up roll 60. The nature of this treatment zone is dependent upon the composition of the substrate. As depicted, driven rolls 52,54 are used to assist in drawing the substrate web through the patterning station and treatment zone 50 and onto take-up roll 60. If desired, of course, the patterned fabric containing unfixed liquid dye may be subjected to other treatments prior to drying and/or fixing.

The process and apparatus disclosed herein has been used to pattern or color a variety of commercially available textile substrates, and has resulted in many visually distinctive effects. The following illustrative example is intended to demonstrate the embodiment of the invention wherein the substrate was dyed using the apparatus and process of FIGS. 1 and 3 through 11, and is not intended to be limiting in any way.

EXAMPLE 1

An eleven ounce per square yard warp knit, 100 percent polyester, pile upholstery fabric having a 3/32 inch pile height, was first conventionally padded to 80 percent of weight of the dry fabric with a light brown disperse dye solution. The fabric was then immediately passed through a spray dye application treatment similar to that depicted in FIGS. 3 through 10, where a vertical stripe pattern of burgundy, light blue and green disperse dye solution was overdyed at approximately 60 percent wet pick up, based on the weight of the dry fabric, using the spray dye application technique disclosed above. Dye flowing at the rate of 28 grams/minute per jet was sprayed onto the substrate through nozzles having an inside diameter of 0.019 inch and a jet-to-jet lateral spacing along the array of 0.4 inch. Air jet supply pressure was 42 p.s.i.g., and air jet aperture inside diameter was 0.040 inch. Substrate speed was five yards per minute, and substrate-to-jet spacing was approximately 5.25 inches.

The fabric was then passed through the dye rearrangement/removal treatment, similar to that depicted in FIGS. 1 and 11, comprised of a plurality of air orifices mounted in a linear array having a lateral spacing of 25 orifices/inch and spaced 1/32 inch from the face of fabric, where air at 35 p.s.i.g. supply pressure removed dye in pattern form. The fabric was then conventionally thermosol dyed at 380° F. for three minutes, washed, and dried. The resultant pattern is depicted in FIG. 15 (1.15 X). The areas impacted by the dye rearranging-/removing air jets are shown as the lighter, leaf-shaped areas of FIG. 15. FIG. 16 (10 X) shows the fabric in cross section. The right side of FIG. 16 depicts an area of the resultant fabric that was overdyed in the spray dye treatment zone only. The left side of FIG. 16 depicts an area of the resultant fabric corresponding to a leaf-shaped area, which was overdyed in the spray dye treatment zone and where some of the dye was subsequently removed by the action of the rearranging-/removing jets. Yarns on this left side therefore carry a lower concentration of the sprayed dye than do yarns on the right side. The right and left sides therefore exhibit different colors, due to the different relative concentrations of the (same) dye which resides on each side.

Many factors influence the degree to which liquid dye may be displaced or removed from a substrate in accordance with the teachings of this invention. For example, gas stream velocity, relative substrate speed, and orifice-to-substrate spacing have been found to influence appreciably the extent to which the impinging gas stream has sufficient energy to move or entrain a visually significant quantity of dye. The graph of FIG. 17 attempts to approximate the functional relationship between momentum flux and the percent of liquid dye removed from a dye-wet substrate of the type contemplated in the examples, for the case of a single jet. In the graph of FIG. 17, it may be seen that increasing the momentum flux as by increasing gas stream velocity or decreasing the substrate-to-jet spacing, generally results in increased dye removal.

It should be understood that variations and modifications to the above teachings may be made without departing from the substance of the invention as described.

We claim:

1. A method for patterning the surface of a textile substrate, comprising the steps of:

(a) applying a quantity of liquid dye to said substrate by spraying said substrate with droplets of liquid dye;

(b) maintaining said dye in a substantially unfixed condition;

(c) contacting said substrate with a plurality of pressurized displacing gas streams, said streams being directed at said dye on said surface with sufficient energy to displace a quantity of said liquid dye on said substrate surface in the area impinged upon by said streams, and (d) moving said substrate along a path which includes said gas streams, wherein said plurality of gas streams are positioned across said path, and wherein said pressurized gas streams are interrupted individually in accordance with pattern information.

2. The method of claim 1 wherein said liquid dye is sprayed on said substrate by projecting a substantially continuous liquid dye stream along a path which precludes contact with said substrate, forming a pressurized dispersing stream of a gaseous dispersing agent, said dispersing stream being projected in an expanding trajectory directed at said substrate and being oriented to provide for the contact of said liquid dye stream with said dispersing stream, said dispersing stream having sufficient maximum pressure to form from said dye stream a shower of diverging droplets of marking material and to project at least a portion of said diverging droplets onto said substrate.

3. The method of claim 2 wherein portions of said displacing gas streams impinging upon said substrate penetrate completely said substrate and expel liquid dye from areas of said substrate surface directly opposite the area of penetration.

4. The method of claim 2 wherein portions of said displacing gas streams impinging upon said substrate are reflected by said substrate and are thereby directed outwardly from said substrate surface, carrying therewith liquid dye from said substrate surface impinged upon by said streams.

5. A method for continuously patterning the surface of a moving textile web comprising:

(a) subjecting said web surface to a first gas stream treatment, said first treatment comprising spraying areas of said moving substrate with droplets of a liquid dye propelled by a first gas stream;

(b) subjecting said moving dye carrying surface to a second gas stream treatment, said second treatment comprising impinging said sprayed surface with a second stream of pressurized gas having sufficient velocity to displace physically a quantity of said sprayed dye from the area of impingement, said substrate reflecting at least a portion of said second stream and directing said reflected stream portion outwardly from said substrate surface, said outwardly directed stream portion carrying therewith unfixed liquid dye from said substrate; and (c) interrupting said second stream as said stream moves over said surface in accordance with pattern information.

6. The method of claim 5 wherein said first gas stream is interrupted in accordance with pattern information.

7. The method of claim 6 wherein said second stream is comprised of substantially unheated air which is directed onto said surface at an impingement angle between 25° and 45°.

* * * * *